US009874195B2

(12) United States Patent
Wolff et al.

(10) Patent No.: US 9,874,195 B2
(45) Date of Patent: Jan. 23, 2018

(54) PRESSURE-MEASURING GLOW PLUG DEVICE

(71) Applicant: Robert Bosch GmbH, Stuttgart (DE)

(72) Inventors: Janpeter Wolff, Wurmberg (DE); Wolfgang Koetzle, Ehningen (DE)

(73) Assignee: Robert Bosch GmbH, Stuttgart (DE)

( * ) Notice: Subject to any disclaimer, the term of this patent is extended or adjusted under 35 U.S.C. 154(b) by 463 days.

(21) Appl. No.: 14/404,486

(22) PCT Filed: Apr. 30, 2013

(86) PCT No.: PCT/EP2013/058958

§ 371 (c)(1),
(2) Date: Nov. 28, 2014

(87) PCT Pub. No.: WO2013/178416

PCT Pub. Date: Dec. 5, 2013

(65) Prior Publication Data

US 2015/0136054 A1 May 21, 2015

(30) Foreign Application Priority Data

May 31, 2012 (DE) ..... 10 2012 209 237

(51) Int. Cl.
*F02P 19/02* (2006.01)
*F23Q 7/00* (2006.01)

(52) U.S. Cl.
CPC ..... *F02P 19/028* (2013.01); *F23Q 7/001* (2013.01); *F23Q 2007/002* (2013.01)

(58) Field of Classification Search
CPC ..... G01L 23/10; G01L 23/00; G01L 23/22; G01L 23/222; G01M 15/08; F02B 77/085;

(Continued)

(56) References Cited

U.S. PATENT DOCUMENTS 6,539,787 B1 * 4/2003 Murai ..... F02D 35/023 73/114.21
7,712,444 B2 * 5/2010 Kern ..... F23Q 7/001 123/145 A (Continued)

FOREIGN PATENT DOCUMENTS

CN 1904348 A 1/2007
CN 101128723 A 2/2008

(Continued)

OTHER PUBLICATIONS

ASME B16.5—2003.*

(Continued)

*Primary Examiner* — Carlos A Rivera
*Assistant Examiner* — Carl Staubach
(74) *Attorney, Agent, or Firm* — Maginot, Moore & Beck LLP

(57) ABSTRACT

A pressure-measuring glow plug device includes a module housing, a glow plug configured to ignite a combustion mixture in a combustion chamber of an internal combustion engine, and a pressure-measuring device. The pressure-measuring device has a pressure sensor configured to detect the pressure in the combustion chamber. The glow plug is connected to the module housing by a flexurally elastic membrane. The force acting on the glow plug in the combustion chamber is transferred to the pressure sensor, which is supported on a supporting element by a preloading force. The supporting element is fastened rigidly to the module housing by a sensor housing. The glow plug device further includes a separate loading sleeve that is connected at one end to the pressure-transferring piece and at the other end to the supporting element. The loading sleeve is configured to apply the preloading force for the pressure sensor.

9 Claims, 2 Drawing Sheets

(58) Field of Classification Search
CPC .. F02D 35/023; F23Q 7/001; F23Q 2007/002; F02P 19/028
USPC ..... 73/114.16–114.19, 35.12, 715; 123/145 A, 145 R, 179.6, 435; 219/260, 219/270; 361/283.4
See application file for complete search history.

(56) References Cited

U.S. PATENT DOCUMENTS

| | | | | |
|---|---|---|---|---|
| 8,205,490 | B2 * | 6/2012 | Mueller | G01L 23/10 73/114.16 |
| 8,217,309 | B2 * | 7/2012 | Burrows | F23Q 7/001 219/260 |
| 8,857,250 | B2 * | 10/2014 | Doering | G01L 19/0681 73/114.18 |
| 2005/0061063 | A1 * | 3/2005 | Haussner | F23Q 7/001 73/114.18 |
| 2005/0166682 | A1 * | 8/2005 | Tanaka | G01L 1/18 73/753 |
| 2006/0053875 | A1 * | 3/2006 | Haussner | F23Q 7/001 73/114.19 |
| 2009/0165739 | A1 * | 7/2009 | Kern | F23Q 7/001 123/145 R |
| 2009/0314061 | A1 | 12/2009 | Kern et al. | |
| 2010/0032423 | A1 | 2/2010 | Kern et al. | |
| 2010/0147822 | A1 | 6/2010 | Burrows et al. | |
| 2010/0300186 | A1 * | 12/2010 | Kern | F23Q 7/001 73/114.19 |
| 2011/0005308 | A1 | 1/2011 | Kern et al. | |
| 2011/0088460 | A1 * | 4/2011 | Mueller | G01L 23/10 73/114.19 |
| 2011/0197666 | A1 * | 8/2011 | Cheng | F23Q 7/001 73/114.19 |
| 2013/0319094 | A1 * | 12/2013 | Nakamura | G01M 15/08 73/114.19 |

FOREIGN PATENT DOCUMENTS

| | | | |
|---|---|---|---|
| CN | 101166960 | A | 4/2008 |
| CN | 101614609 | A | 12/2009 |
| CN | 101983303 | A | 3/2011 |
| CN | 102016422 | A | 4/2011 |
| DE | 10 2006 008 639 | A1 | 6/2004 |
| DE | 10 2006 008 350 | A1 | 8/2007 |
| DE | 10 2006 008 351 | A1 | 8/2007 |
| DE | 10 2006 049 079 | A1 | 4/2008 |
| JP | 2004-163091 | A | 6/2004 |
| WO | 2007/096208 | A1 | 8/2007 |
| WO | 2009/053170 | A1 | 4/2009 |
| WO | 2009/146565 | A1 | 12/2009 |

OTHER PUBLICATIONS

International Search Report corresponding to PCT Application No. PCT/EP2013/058958, dated Jul. 15, 2013 (German and English language document) (7 pages).

* cited by examiner

PRESSURE-MEASURING GLOW PLUG DEVICE

This application is a 35 U.S.C. §371 National Stage Application of PCT/EP2013/058958, filed on Apr. 30, 2013, which claims the benefit of priority to Serial No. DE 10 2012 209 237.4, filed on May 31, 2012 in Germany, the disclosures of which are incorporated herein by reference in their entirety.

BACKGROUND

The disclosure relates to a pressure-measuring glow plug device for insertion into a cylinder head of an internal combustion engine having the features of the disclosure.

PRIOR ART

A pressure-measuring glow plug device of this type is known from WO 2007/096208 A1, in which a glow plug for igniting a combustion mixture of an internal combustion engine and a pressure-measuring device with a pressure sensor for detecting a combustion chamber pressure of the internal combustion engine are arranged in a housing. The glow plug is exposed to the combustion chamber pressure and, as pressure pickup, transmits the combustion chamber pressure to the pressure sensor, the pressure sensor being received between the glow plug which acts as pressure pickup and a supporting element in a sensor housing. A resiliently flexible diaphragm is arranged between the sensor housing and the glow plug which serves as pressure pickup, which diaphragm makes the required axial longitudinal movement of the glow plug for pressure transmission possible and at the same time applies the required prestressing force for the pressure sensor. As a result, the forces which act on the resiliently flexible diaphragm during the mounting of the glow and pressure-measuring module also have an effect on the prestress of the pressure sensor.

SUMMARY

The disclosure has the advantage that a glow and pressure-measuring module has been produced, in which the pressure sensor is prestressed between the pressure transmission piece and the supporting element by means of a clamping sleeve which is used in addition to the sensor housing. As a result, the prestressing force for the pressure sensor remains uninfluenced during the installation of the glow and pressure-measuring module into the housing of the pressure-measuring glow plug device.

Advantageous developments of the disclosure are possible as a result of the measures of the subclaims.

The clamping sleeve, the pressure transmission piece, the supporting element and the pressure sensor which is surrounded by it form a pre-assembled sensor unit which can be inserted into an end section of the sensor housing, which end section faces away from the combustion chamber. As a result, the sensor unit can be mounted independently of the glow and pressure-measuring module. The forces which act on the resiliently flexible diaphragm during mounting therefore do not act on the prestress of the pressure sensor. The supporting element is given its firm fixing in housing terms by the sensor housing being connected to the supporting element with an end section which faces away from the combustion chamber and being connected to the housing of the pressure-measuring glow plug device at an end section which faces the combustion chamber. As a result, the sensor unit is at the same time fixed firmly in housing terms in the sensor housing.

In order to exert an axial longitudinal movement for pressure transmission, the glow plug is connected to the sensor housing by means of the resiliently flexible diaphragm at an end section which faces the combustion chamber. For the transmission of force, a connecting sleeve which surrounds the glow plug at the end section which faces away from the combustion chamber and which is connected at least indirectly to the glow plug is flange-connected to the pressure transmission piece.

The connecting sleeve expediently forms a receiving space for a glow current contact on the glow plug side, in which receiving space the glow current contact makes contact with a glow current line. Here, the glow current line is guided through the sensor unit, the pressure transmission piece having a first leadthrough and the supporting element having a second leadthrough for this purpose, through which the glow current line is guided, it being possible for the glow current line to make contact with a high current connector which lies outside the sensor unit.

The components which are connected to the sensor housing form a glow and pressure-measuring module which can be inserted into the glow module housing of the pressure-measuring glow plug device as a structural unit which can be pre-assembled. The glow and pressure-measuring module is connected fixedly to the housing of the pressure-measuring glow plug device by means of a fastening point which is configured on the sensor housing, the fastening point being formed by a supporting section which is configured on the sensor housing.

BRIEF DESCRIPTION OF THE DRAWINGS

One exemplary embodiment of the disclosure is shown in the drawings and is explained in greater detail in the following description.

In the drawings.

DETAILED DESCRIPTION

Figure 1:
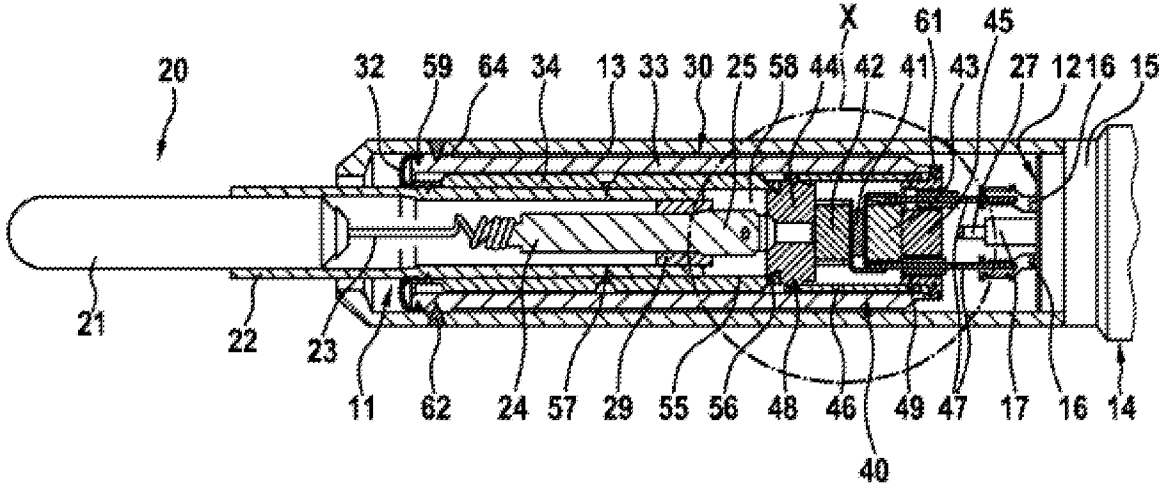
FIG. 1 shows a sectional illustration through a section on the combustion chamber side of a pressure-measuring glow plug device according to the disclosure.

The pressure-measuring glow plug device which is shown in FIG. 1 combines a conventional glow plug 20 for use in compression-ignition internal combustion engines with an additional pressure-measuring function of a pressure-measuring device 30 for detecting a combustion chamber pressure of the internal combustion engine. The pressure-measuring glow plug device comprises substantially a glow and pressure-measuring module 11 which is accommodated in a housing 13 of the pressure-measuring glow plug device, which housing 13 will be called the glow module housing in the following text, and a connector module 14 which is not shown in greater detail and is accommodated in a connector module housing 15. Two sensor connectors 16 for the pressure-measuring device 30 and a high current connector 17 for the glow plug device 20 which lead in the connector module 14 to electrical connections (not shown) for a connector plug are formed on the connector module 14 so as to protrude into the glow module housing 13 and to be exposed there. A signal processing unit for preprocessing the signals of the pressure-measuring device 30 can be integrated into the connector module 14.

The components of the glow plug device 20 for igniting the internal combustion engine and the components of the pressure-measuring device 30 for combustion chamber pressure measurement are accommodated in the glow and pressure-measuring module 11. The glow plug device 20 comprises a glow plug 21 which protrudes out of the glow module housing 13 on the combustion chamber side, protrudes with the projecting part into the combustion chamber of the internal combustion engine and at the same time as a result forms a pressure pickup for the pressure which prevails in the combustion chamber. In the present exemplary embodiment, the glow plug 21 is a ceramic glow plug, into which an electrical heating element (not shown) is embedded. The ceramic glow plug 21 is surrounded by a metallic supporting tube 22. The heating element (not shown) is connected via an outer contact to the supporting tube 22 in order to form one pole and is connected via an electrical connection 23 to a glow current contact 24 in order to form the other pole, the glow current contact 24 being guided out of the supporting tube 22 as a solid connector bolt such that an end section 25 which faces away from the combustion chamber is exposed. The electrical connection from the glow current contact 24 to the high current connector 17 on the connector module 12 is realized by means of a glow current line 27.

Furthermore, an electrically insulating sealing element 29 is arranged between the supporting tube 22 and the glow current contact 24. However, it is also conceivable to configure the glow plug 21 as a metallic glow tube with an embedded heating coil.

The pressure-measuring device 30 is accommodated within the glow module housing 13 and comprises a sensor unit 40, a resiliently flexible diaphragm 32, a sensor housing 33 and a connecting sleeve 34.

The sensor unit 40 comprises a piezoelectric pressure sensor 41, a pressure piece 42 on the glow plug side, a pressure piece 43 on the supporting element side, a pressure transmission piece 44, a supporting element 45 and a clamping sleeve 46. The clamping sleeve 46 is of flexible configuration for the purpose of the realization of an axial movement of the pressure transmission piece 44 for the transmission of force to the pressure sensor 41. To this end, the clamping sleeve 46 is configured, for example, as a tubular spring. The pressure pieces 41, 42 are produced from an electrically insulating material. The pressure sensor 41 is positioned between the pressure piece 42 on the glow plug side and the pressure piece 43 on the supporting element side by means of a prestressing force which is applied by the clamping sleeve 46. The pressure sensor 41 has two sensor lines 47 which are connected electrically to the two sensor connectors 16.

The pressure transmission piece 44 and the supporting element 45 are connected by means of the resilient clamping sleeve 46 in such a way that firstly the required prestress acts on the pressure sensor 41 and that secondly the pressure transmission piece 44 can perform the axial movement which is necessary for the transmission of force to the pressure sensor 41. As a result, the clamping sleeve 46 forms a separate clamping element for the pressure sensor 41 independently of the sensor housing 33. For the fixed connection of the clamping sleeve 46 to the pressure transmission piece 44 and the supporting element 45, the clamping sleeve 46 is connected at the pressure transmission piece 44 by means of a first welded seam 48 and at the supporting element 45 by means of a second welded seam 49. As a result, the sensor unit 40 forms a structural unit which can be pre-assembled separately from the glow and pressure-measuring module 11.

Figure 2:
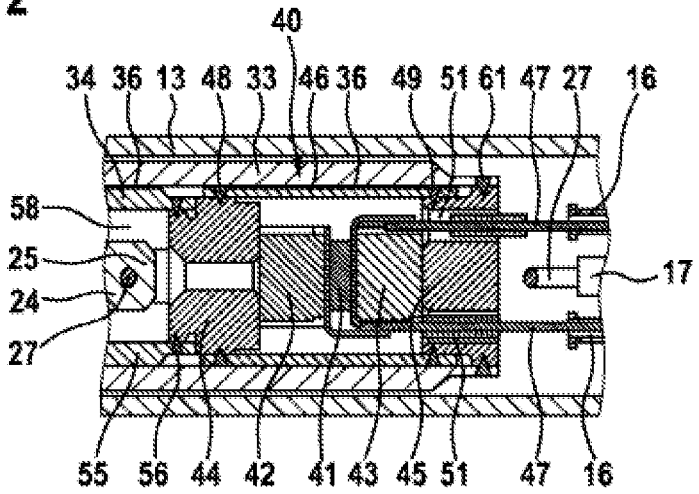
FIG. 2 shows an enlarged detail X in FIG. 1.

The sensor lines 47 are guided out of the sensor unit 40 on the connector module side. To this end, according to FIG. 2, two leadthroughs 51 are provided in the supporting element 45, through which leadthroughs 51 the two sensor lines 47 are guided toward the sensor connectors 16.

Figure 3:
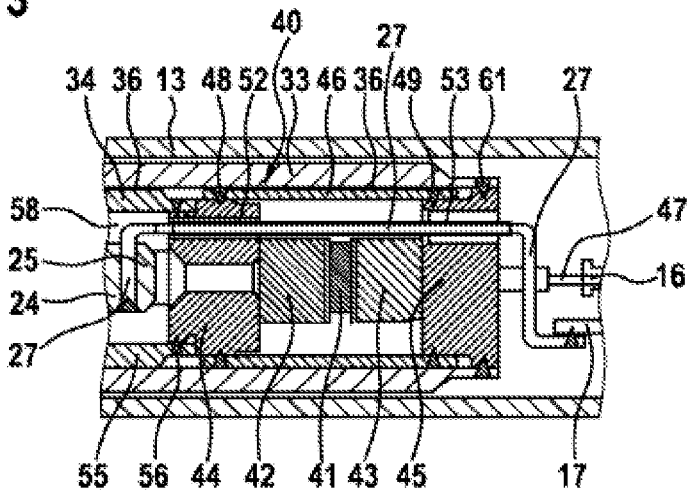
FIG. 3 shows the enlarged detail X in FIG. 2 in an illustration which has been rotated axially by 180°.

In order to realize the contact between the glow current contact 24 and the high current connector 17, the glow current line 27 is guided through the sensor unit 40. To this end, according to FIG. 3, the pressure transmission piece 44 has a first leadthrough 52 for leading through the glow current line 27 toward the glow current contact 24, and the supporting element 45 has a second leadthrough 53 for leading through the glow current line 27 toward the high current connector 17. The glow current line 27 which is guided substantially axially through the sensor unit 30 has a first 90 degree bend on the glow plug side and a second 90 degree bend on the connector side, with the result that the glow current line 27 can be guided axially through the sensor unit 40. For contact with the glow current contact 24, a radial bore is made in the connector-side end section 25 of the glow current contact 24, into which radial bore the first 90 degree bend of the glow current line 27 is introduced and makes electrical contact there.

In order to realize the pressure transmission from the glow plug 21 to the pressure sensor 41, the glow plug 21 is mounted axially displaceably in the glow module housing 13 by means of the resiliently flexible diaphragm 32. Furthermore, a transmission of force takes place from the glow plug 21 to the pressure transmission piece 44 of the sensor unit 40. To this end, the supporting tube 22 which is connected fixedly to the glow plug 21 with the connecting sleeve 34 is extended axially in the direction of the sensor unit 40 with an end section 55. The extended end section 55 is placed on a collar which is configured on the pressure transmission piece 44 and is connected there by means of a first welded seam 56 to the pressure transmission piece 44. The supporting tube 22 and the connecting sleeve 34 are connected fixedly by means of a second welded seam 57. A hollow-cylindrical receiving space 58 is therefore formed within the end section 55, in which receiving space 58 the connector-side end section 25 of the glow current contact 24 is exposed and makes contact there with the glow current line 27.

In order to configure the glow and pressure-measuring module 11, the resiliently flexible diaphragm 32 is connected to the sensor housing 33 by means of a third welded seam 59. The sensor housing 33 is welded on the supporting element 45 by means of a fourth welded seam 61. The second welded seam 49 for connecting the clamping sleeve 46 and the fourth welded seam 61 for connecting the sensor housing 33 are configured on different diameters of the supporting element 45. As a result, there is a further structural unit which can be pre-assembled with the glow and pressure-measuring module 11, in which further structural unit the sensor unit 40 is received as a first structural unit which can be pre-assembled, and which further structural unit is inserted into the glow module housing 13 and is connected fixedly to the glow module housing 13. It has proven expedient that an annular gap 36 is formed between the outer wall of the connecting sleeve 34 and the inner wall of the sensor housing 33, and between the outer wall of the clamping sleeve 34 and the inner wall of the sensor housing 33. The annular gap 36 serves to provide a friction-free spacing for the axial displacement of the connecting sleeve 34 and the resilient clamping sleeve 34 relative to the sensor housing 33 which is fixed in housing terms.

In order to fasten the glow and pressure-measuring module 11 in the glow module housing 13, an outer supporting section 64 is configured on the sensor housing 33, which outer supporting section 64 is adapted by way of its external diameter to the internal diameter of the glow module housing 13. The supporting section 64 forms a connecting point on the sensor housing 13, to which the sensor housing 33 on the glow module housing 13 is connected by means of a further welded seam 62. The further welded seam 62 and the third welded seam 59 are of circumferential configuration for sealing purposes.

The prestress for the pressure sensor 41 is therefore applied by the clamping sleeve 46 and not by the spring force of the resiliently flexible diaphragm 32. As a result, the prestress for the pressure sensor 41 can be set outside the glow and pressure-measuring module 11 on the pre-assembled sensor unit 40. As a result, the prestress of the pressure sensor 41 is not influenced by the spring force of the resilient diaphragm 32 or by the following assembly steps during the insertion of the glow and pressure-measuring module 11 into the glow module housing 13.

The pressure which prevails in the combustion chamber and exerts a pressure force on the glow plug 21 which acts as pressure pickup causes the glow plug 21 with the supporting tube 22 and the connecting sleeve 34 to perform an axial movement along the longitudinal axis of the pressure-measuring glow plug device, on account of the resiliently flexible diaphragm 32, with respect to the glow module housing 13 which is fastened fixedly in the cylinder head. The pressure force acts on the pressure transmission piece 44 and the latter presses via the first pressure piece 42 on the pressure sensor 41 on account of the resilient action of the clamping sleeve 46, which pressure sensor 41 is supported via the second pressure piece 43 on the supporting element 45 which is connected fixedly to the sensor housing 33 and is fixed as a result.

The invention claimed is:

1. A pressure-measuring glow plug device, comprising:

a glow module housing;

a glow plug arranged in the glow module housing and configured to ignite a combustion mixture in a combustion chamber of an internal combustion engine; and a pressure-measuring device arranged in the glow module housing, the pressure-measuring device having a pressure sensor configured to detect a combustion chamber pressure of the internal combustion engine, wherein the glow plug acts as a pressure pickup and is connected to the glow module housing by a resiliently flexible diaphragm, the force acting on the glow plug in the combustion chamber being transmitted to the pressure sensor, wherein the pressure sensor is arranged by a prestressing force between a pressure transmission piece and a supporting element, the supporting element being fixed firmly to the glow module housing via a sensor housing, wherein a clamping sleeve is connected with one end to the pressure transmission piece and with the other end to the supporting element, the clamping sleeve being configured to apply the prestressing force for the pressure sensor, and wherein the clamping sleeve, the pressure transmission piece, and the supporting element surround the pressure sensor and together with the pressure sensor form a pre-assembled sensor unit, the pre-assembled sensor unit configured to be inserted into the sensor housing through an end section of the sensor housing that faces away from the combustion chamber.

2. The pressure-measuring glow plug device as claimed in claim 1, wherein the sensor housing is connected to the supporting element at the end section of the sensor housing.

3. The pressure-measuring glow plug device as claimed in claim 2, wherein:

the supporting element has an outer circumferential surface with a first diameter and a second diameter that is different than the first diameter, the clamping sleeve is connected to the supporting element on the first diameter, and the sensor housing is connected to the supporting element on the second diameter.

4. The pressure-measuring glow plug device as claimed in claim 1, wherein the sensor housing is connected to the resiliently flexible diaphragm at an end section that faces the combustion chamber.

5. The pressure-measuring glow plug device as claimed in claim 1, wherein the sensor housing is connected fixedly to the glow module housing by a fastening point.

6. The pressure-measuring glow plug device as claimed in claim 5, wherein a supporting section that forms the fastening point for fastening to the glow module housing is configured on the sensor housing.

7. The pressure-measuring glow plug device as claimed in claim 1, wherein a connecting sleeve that is connected at least indirectly to the glow plug is flange-connected to the pressure transmission piece.

8. The pressure-measuring glow plug device as claimed in claim 7, wherein the connecting sleeve forms a receiving space for a glow current contact on the glow plug side, the glow current contact making contact with a glow current line in the receiving space.

9. The pressure-measuring glow plug device as claimed in claim 8, wherein the pressure transmission piece has a first leadthrough and the supporting element has a second leadthrough for the glow current line such that the glow current line is guided through the sensor unit and is configured to make contact with a high current connector that lies outside the sensor unit.

* * * * *